US007758419B2

(12) United States Patent
Rowe et al.

(10) Patent No.: US 7,758,419 B2
(45) Date of Patent: Jul. 20, 2010

(54) METHOD AND APPARATUS FOR DELIVERING INFORMATION AND/OR A BONUS AWARD TO PLAYERS OF A GAMING TABLE

(75) Inventors: Richard E. Rowe, Las Vegas, NV (US); Scott Boyd, Las Vegas, NV (US); Kevan Wilkins, Las Vegas, NV (US)

(73) Assignee: IGT, Reno, NV (US)

( * ) Notice: Subject to any disclaimer, the term of this patent is extended or adjusted under 35 U.S.C. 154(b) by 552 days.

(21) Appl. No.: 11/225,866

(22) Filed: Sep. 12, 2005

(65) Prior Publication Data

US 2006/0073885 A1 Apr. 6, 2006

Related U.S. Application Data

(60) Provisional application No. 60/616,090, filed on Oct. 4, 2004.

(51) Int. Cl.
*A63F 9/24* (2006.01)

(52) U.S. Cl. ..... 463/25

(58) Field of Classification Search ..... 463/16–20, 463/25–28

See application file for complete search history.

(56) References Cited

U.S. PATENT DOCUMENTS 4,133,530 A * 1/1979 Takaichi et al. ..... 463/46
5,544,893 A * 8/1996 Jones et al. ..... 273/309
5,573,248 A 11/1996 Parra et al.
5,586,936 A * 12/1996 Bennett et al. ..... 463/25
5,651,548 A 7/1997 French et al.
5,735,742 A 4/1998 French
5,743,800 A * 4/1998 Huard et al. ..... 463/26
5,770,533 A 6/1998 Franchi
5,779,546 A * 7/1998 Meissner et al. ..... 463/25
5,911,419 A * 6/1999 Delaney et al. ..... 273/292
6,039,650 A 3/2000 Hill
6,164,652 A 12/2000 Lauretta et al.
6,299,534 B1 10/2001 Breeding et al.
6,299,536 B1 10/2001 Hill
6,345,824 B1 * 2/2002 Selitzky ..... 273/292
6,379,247 B1 4/2002 Walker et al.

(Continued)

FOREIGN PATENT DOCUMENTS

EP 1291045 A2 12/2003

OTHER PUBLICATIONS

PCT patent application No. PCT/US2005/033160, International Search Report dated Mar. 15, 2006.

(Continued)

*Primary Examiner*—Scott Jones
(74) *Attorney, Agent, or Firm*—Weaver Austin Villeneuve & Sampson LLP

(57) ABSTRACT

A gaming table assembly for a table game configured to deliver a bonus game to a player at the gaming table. The assembly including a gaming table, a dealer station for a gaming dealer, and a plurality of player stations for one or more players. At least one interactive display terminal is included associated with the gaming table that is dedicated to one or more of the plurality of player stations. The display terminal is configured to display content selected from the group consisting of a bonus game, an advertisement, player tracking information, news and bonus awards.

20 Claims, 6 Drawing Sheets

U.S. PATENT DOCUMENTS

| | | | | |
|---|---|---|---|---|
| 6,553,919 | B1 * | 4/2003 | Nevin | 108/50.01 |
| 6,582,301 | B2 | 6/2003 | Hill | |
| 6,609,975 | B1 * | 8/2003 | Sawyer et al. | 463/26 |
| 6,638,167 | B1 * | 10/2003 | Sawyer et al. | 463/26 |
| 6,659,866 | B2 * | 12/2003 | Frost et al. | 463/17 |
| 6,672,589 | B1 | 1/2004 | Lemke et al. | |
| 7,306,516 | B2 * | 12/2007 | Iosilevsky | 463/13 |
| 7,309,065 | B2 * | 12/2007 | Yoseloff et al. | 273/292 |
| 2001/0000118 | A1 | 4/2001 | Sines et al. | |
| 2002/0037765 | A1 * | 3/2002 | Johnson | 463/17 |
| 2002/0077170 | A1 * | 6/2002 | Johnson et al. | 463/16 |
| 2003/0003997 | A1 | 1/2003 | Vuong et al. | |
| 2003/0064767 | A1 * | 4/2003 | Brown | 463/12 |
| 2003/0109307 | A1 | 6/2003 | Boyd | |
| 2005/0170875 | A1 * | 8/2005 | Snow | 463/13 |

OTHER PUBLICATIONS

PCT patent application No. PCT/US2005/033160, Written Opinion dated Mar. 15, 2006.

Richard E. Rowe, U.S. Appl. No. 60/616,090, *Method and apparatus for delivering a bonus to players of a table game*, filed Oct. 4, 2004.

Boyd, et al., U.S. Appl. No. 29/238,107, *Informational display assembly or similar article for a gaming table*, filed Sep. 9, 2005.

Chinese Office Action, dated Nov. 28, 2008, from corresponding Application No. 200580033898.1 [Translation attached].

Chinese Office Action, dated May 15, 2009, from corresponding Application No. 200580033898.1 [Translation attached].

Chinese Office Action, dated Dec. 11, 2009, issued in 2005800338981.

* cited by examiner

METHOD AND APPARATUS FOR DELIVERING INFORMATION AND/OR A BONUS AWARD TO PLAYERS OF A GAMING TABLE

RELATED APPLICATION DATA

The present application claims priority under 35 U.S.C. §119 to U.S. Provisional Application Ser. No. 60/616,090, naming Richard E. Rowe as inventor, filed Oct. 4, 2004, and entitled "METHOD AND APPARATUS FOR DELIVERING A BONUS TO PLAYERS OF A TABLE GAME", the entirety of which is incorporated herein by reference for all purposes. The present invention is also related to U.S. Design patent application Ser. No. 29/238,107, naming the same inventors herein, filed Sep. 9, 2005, entitled "INFORMATIONAL DISPLAY ASSEMBLY OR SIMILAR ARTICLE FOR A GAMING TABLE", and issued as U.S. Pat. No. D537,126, the entirety of which is incorporated herein by reference for all purposes.

BACKGROUND OF THE INVENTION

The present invention relates generally to gaming tables, and more particularly, relates to methods and apparatuses for delivering information and/or bonuses to the players of a gaming table.

Traditionally, table games have been limited to only those game that were currently being played at the game table, such as poker or blackjack. Typically, a dealer station is centered around a plurality of player stations. A dealer at the dealer station commences play of the table game to one or more players at the player station surrounding the dealer.

Over time, some alternative game variations have evolved that allowed side bets to the players. The side bets are essentially directly related to the table game being played. Other than that, the players at these gaming tables had no other gaming and/or information display options.

Accordingly, it would be desirable to provide participants at these table games other informational and/or gaming options while they play at these game tables.

SUMMARY OF THE INVENTION

The present invention provides a bonus game delivery system for a gaming table. The gaming table includes a gaming table having a dealer station, and a plurality of discrete player stations. The bonus game delivery system includes a backend bonus award system, and a plurality of discrete terminals. Each terminal is associated with one or more respective player stations at the gaming table. Further, each terminal is networked to and discretely identified by the bonus award system such that a player identified by the bonus award system as being eligible for a bonus award is informed of the bonus award through the associated discrete terminal.

Accordingly, unlike the current conventional game tables, a bonus game delivery system is disclosed that is capable of delivering sophisticated bonus games and awards to the players at a game table. Employing a networked system of player stations that are capable of identifying players through a player tracking system, upon meeting a predetermined formula of criteria, those eligible players can be identified and awarded a bonus award or play a bonus game at a respective identified terminal.

Each discrete terminal includes a display screen and at least one speaker for visual and/or audio indicators of such an award. Further, each discrete terminal includes a support mechanism adapted to mount to the gaming table. These support mechanisms define a receiving pocket formed and dimensioned for receipt of a respective terminal therein.

In one specific embodiment, each support mechanism and associated terminal includes a tilt mechanism cooperating therebetween to enable a respective terminal to be selectively rotatably positioned between one of a plurality of positions about a horizontal axis.

In another configuration, the backend bonus award system is configured to issue a bonus award to the player based upon a predetermined formula. Such a predetermined formula is selected from the group consisting of a win, a loss, a combination of cards, an amount bet and randomly. In other games, the predetermined formula includes randomly issuing the bonus award to one of the player's. In still other bonus games, the predetermined formula includes receiving one or more predetermined cards.

In another aspect of the present invention, a gaming table assembly is provided for a table game including a gaming table; a dealer station for a gaming dealer; and a plurality of player stations for one or more players. The present invention further includes at least one interactive display terminal associated with the gaming table dedicated to one or more of the plurality of player stations. The display terminal is configured to display content selected from the group consisting of a bonus game, an advertisement, player tracking information, news and bonus awards.

In yet another aspect of the present invention, is included for delivering a bonus award to a player playing a table game at a gaming table. The method includes registering a player of the table game in a player tracking system; and registering the position of the player at one of the plurality of playing stations. Further, the method includes receiving a bet from the player; commencing play of the table game; and issuing a bonus award to the player based upon a predetermined formula.

In one embodiment, the method further includes placing a portion of the player's bet into a bonus pool for the bonus award. This portion includes a percentage of the player's bet. In accordance with the present invention, the placing a portion includes determining the amount of the player's bet, and calculating the percentage based upon the player's bet.

In another specific embodiment, the bonus award is selected from the group consisting of a promotional ticket, immediate cash back, and a payout that requires pit boss approval.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DESCRIPTION OF THE PREFERRED EMBODIMENTS

Figure 1:
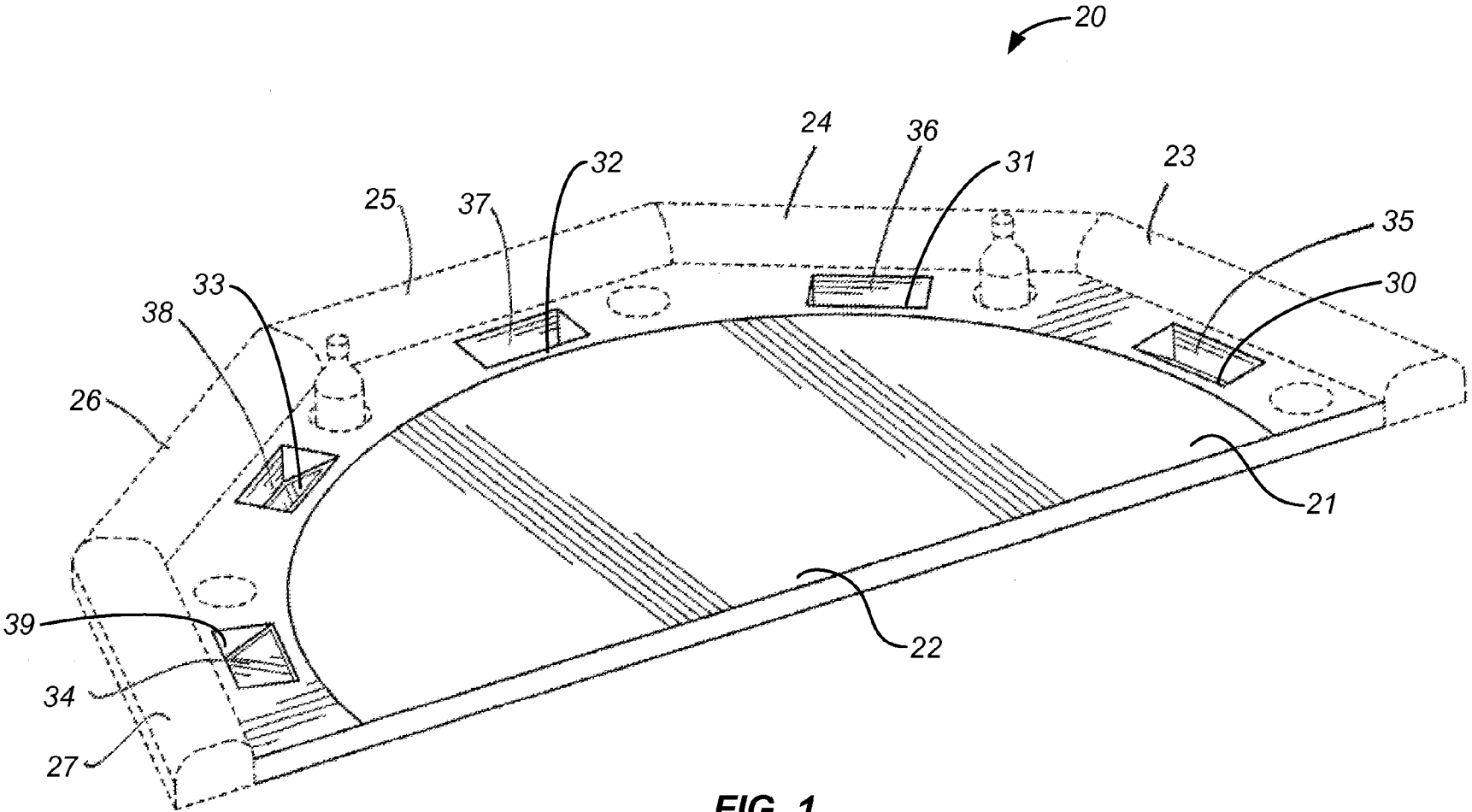
FIG. 1 is a rear perspective view of a gaming table incorporating a plurality of interactive display terminals facilitating information and bonus award delivery as constructed in accordance with the present invention.
Figure 2:
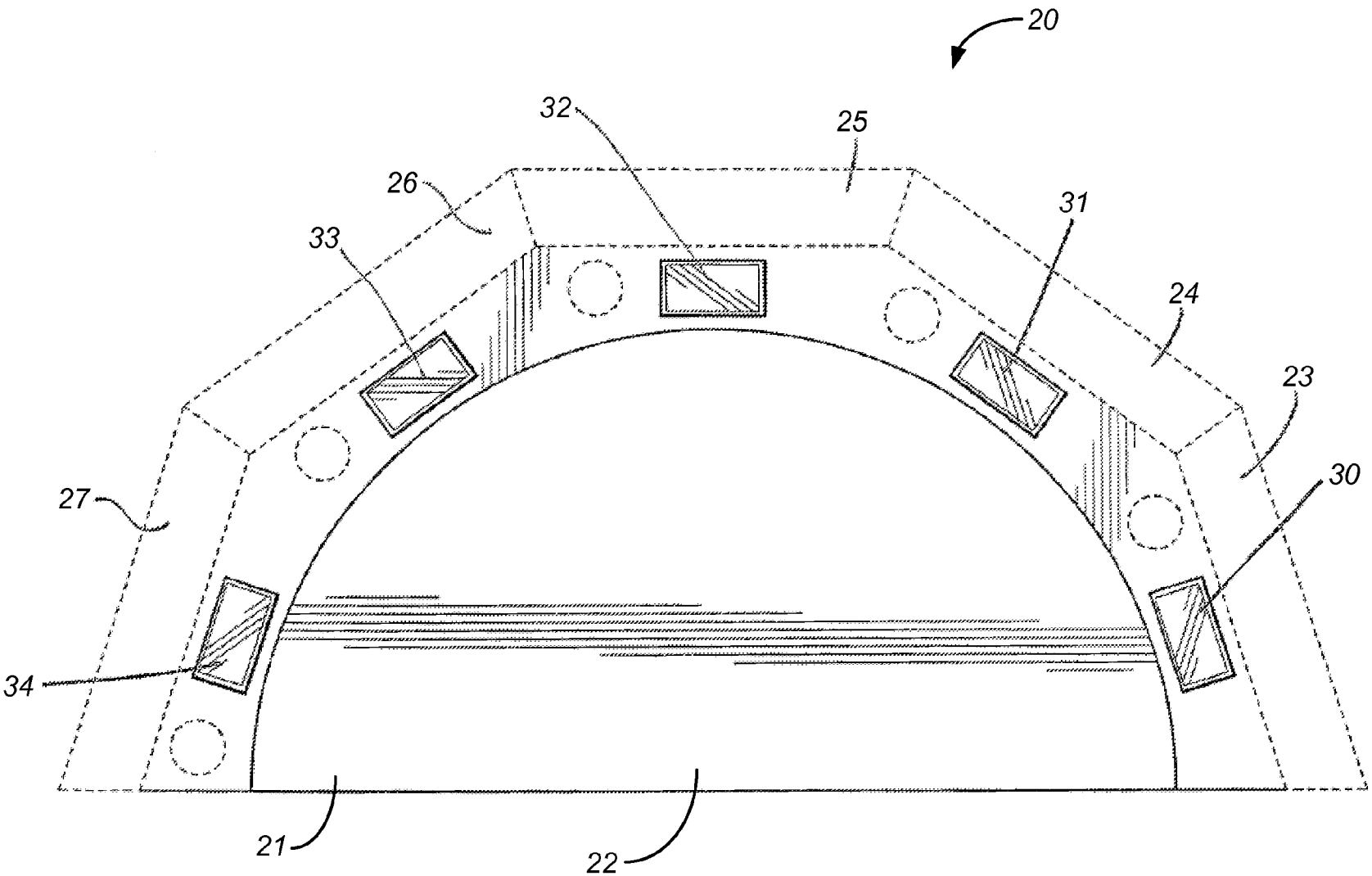
FIG. 2 is a top plan view of the gaming table of FIG. 2.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIGS. 1-4, where a gaming table assembly, generally designated 20, is shown for implementation and delivery of information and/or bonus awards to a gaming table 21 in accordance with the present invention. The gaming table assembly 20 includes a conventionally shaped game table 21 for play of a table game. While the present invention may be applied to non-card table games, the present invention is particularly suited for card-based table games such as blackjack and the numerous variations of poker.

The game table 21 of this type is generally located in a casino or the like, and typically includes a dealer station 22, and a plurality of player stations 23-27, surrounding the dealer station. At the player stations, the players sit or stand during game play, while at the dealer station, the card dealer almost always stands. The dealer also deals the cards and takes the player's bets, on behalf of the casino, from the one more players who are participating in the table game.

In accordance with the present invention, at least one interactive display terminal 30, and more preferably one display terminal 30-34 dedicated to each player station 23-27, is included at the gaming table 21. Each of these interactive display terminals 30-34 is configured to display informational content relating to advertising, player tracking information, news, etc. In particular, however, the display terminals are integrated with a backend bonusing system, and more preferably with the player tracking system, to deliver and operate additional bonus games awards and bonus awards to the gaming table.

Accordingly, as will be described in greater detail, these conventional gaming tables can incorporate and deliver significantly more sophisticated bonus games and bonus awards not previously attainable for table games. Using backend systems, and through the convergence of recent technological advances, the table game players will now have access to additional bonus games and bonus awards at right at their dedicated player stations.

Preferably, each display terminal 30-34 is located atop the surface of game table 21, and is recessed in a respective receiving pocket 35-39, so as not to interfere with card handling and card distribution by the dealer during game play.

Briefly, as best viewed in FIGS. 4-7, each display terminal (terminal 30, for instance) includes a housing 40 that supports a pair of speakers 41 and a display screen 42. A keyboard may be included on the housing (not shown), or provided through a touchscreen keyboard 43 image on the display screen 42, such as that shown in FIG. 8. Further, an associated card reader may be included that is associated with a networked player tracking system and/or associated with some financial institution. Collectively, the display terminals 30-34 and card readers at each player station 23-27 can be networked together with a backend player tracking system and/or a backend bonus game and award system.

These display terminals 30-34, and associated components are similar to those described in co-pending U.S. patent application Ser. No. 10/170,238, filed Jun. 11, 2002, which is incorporated herein by reference for all purposes, and which has the same owner as the present application. This co-pending application illustrates such displays associated with gaming machines and an associated card reader.

The receiving pocket 35 is defined by a support member 45, which is essentially a rectangular bucket or box structure having an upper opening 46 that provides an entrance into the receiving pocket 35. While the support member 45 is illustrated as having essentially solid walls, it could be provided by simple frame structure as well or a combination thereof, as long as sufficient structural integrity is provided to mount the respective display terminal to the game table 21. A support flange 47 extends outwardly from the upper peripheral edge that defines the opening 46 into the receiving pocket 35. This support flange 47 functions to support and/or mount the support member flush with the surface of the gaming table.

Figure 3:
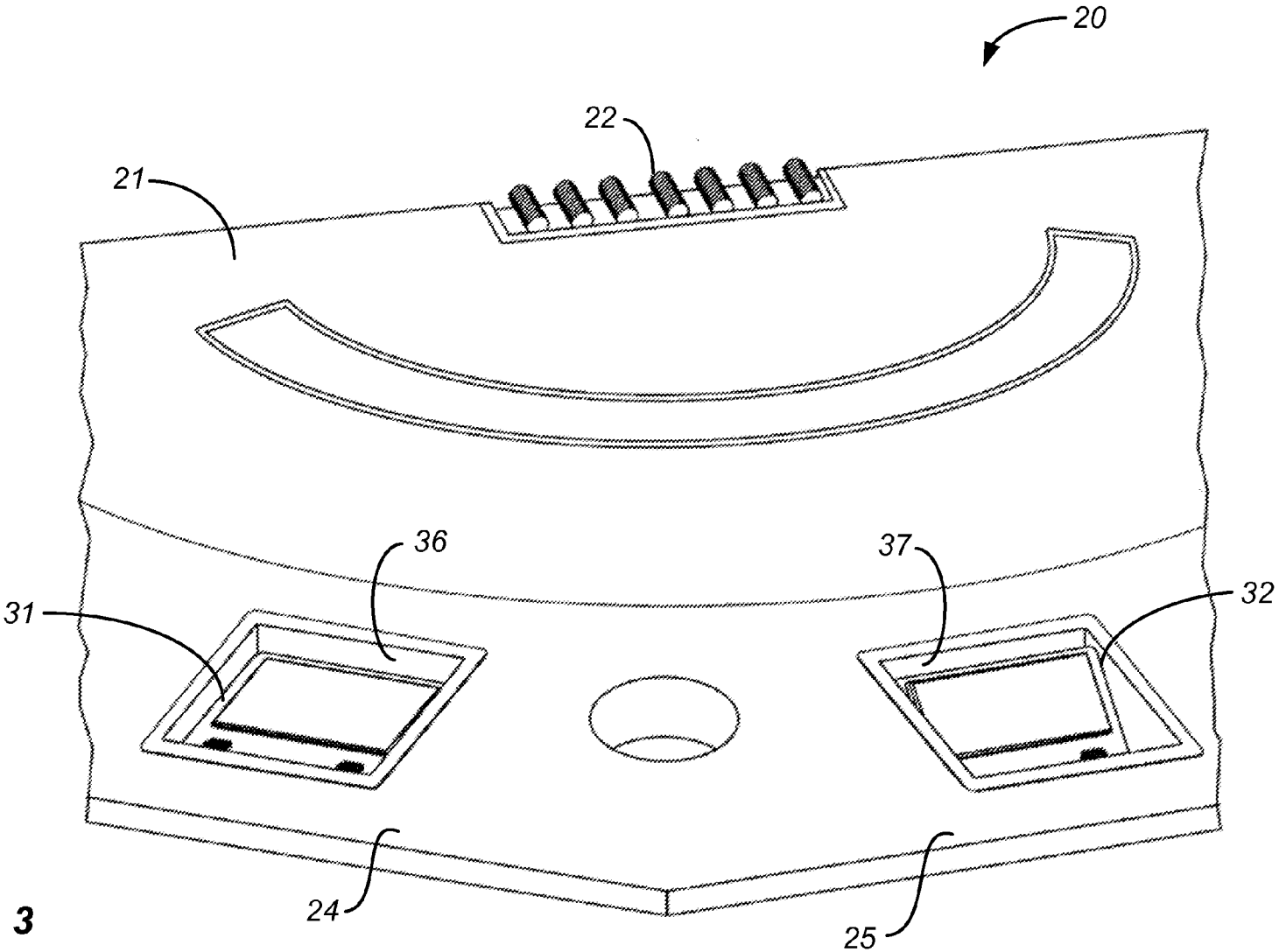
FIG. 3 is a fragmentary, enlarged, front perspective view of the gaming table of FIG. 1, illustrating a dealer station.
Figure 4:
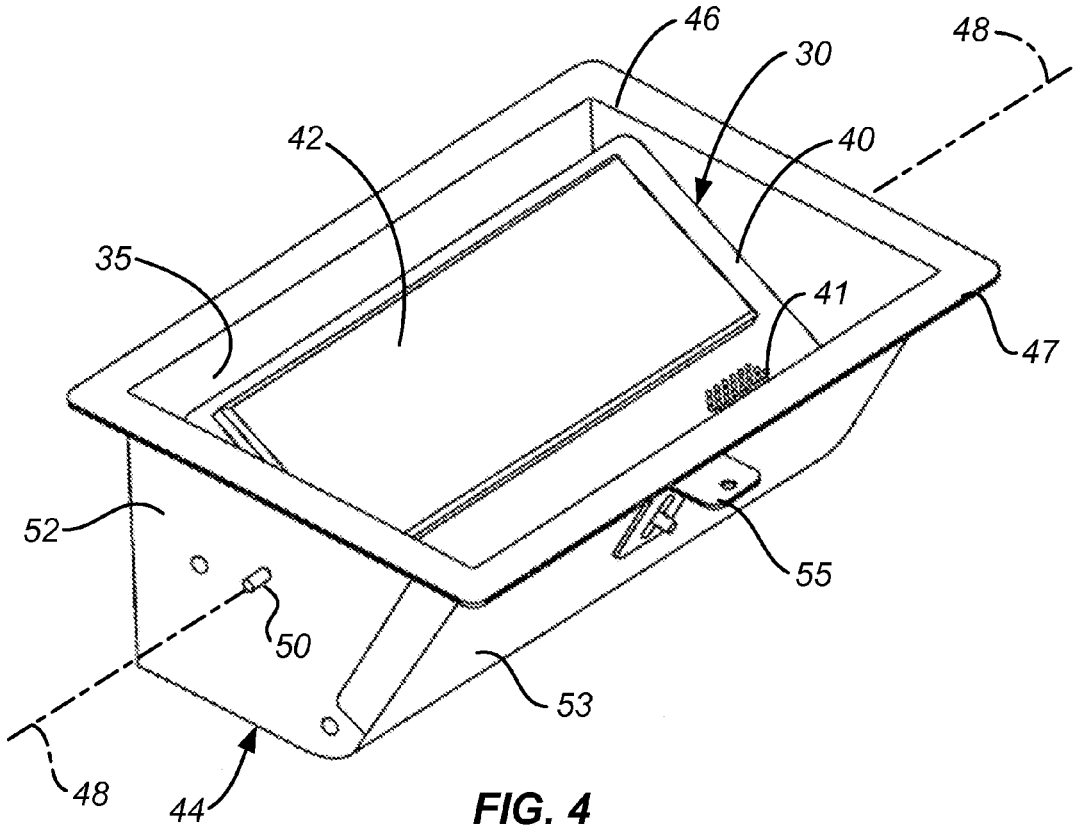
FIG. 4 is an enlarged, top perspective view of an individual interactive display terminal of FIG. 1, shown mounted in a support member in a tilted position.
Figure 5:
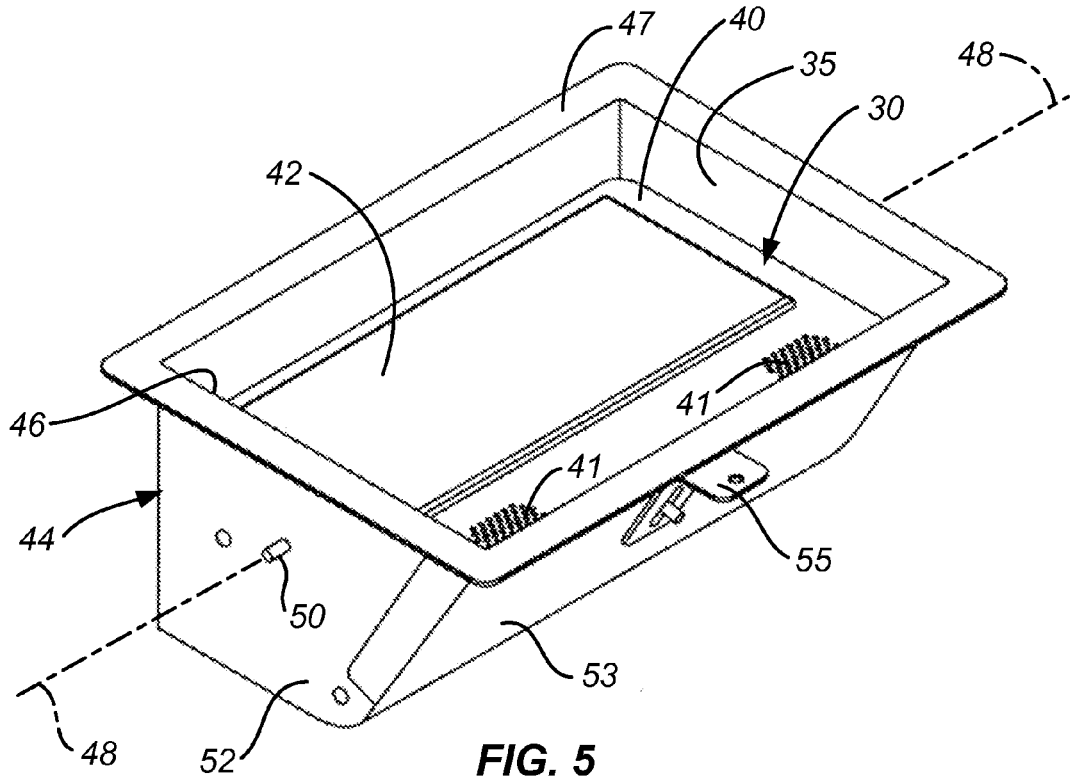
FIG. 5 is a top perspective view of the individual interactive display terminal of FIG. 4, shown in a near horizontal orientation.

In one specific embodiment, the interactive display terminal 30 that is disposed and seated in the receiving pocket is configured for limited rotation about a horizontal axis 48 extending through the sidewalls of the housing 40 (FIGS. 4 and 5). This enables the display terminal to be positioned in one of a plurality of tilt positions in the pocket 35 to aid viewing at the respective player station 23-27 by the player. By way of example, as shown in FIG. 3, the display terminal 31 of player station 24 is oriented in a relatively horizontal position in the pocket 36 of the support member 45, while the display terminal 32 of player station 25 is shown oriented downward at about 45° from the horizontal position. It will be appreciated, of course, that the player is able to manually adjust the tilt orientation of the display terminal without departing from the true spirit and nature of the present invention.

FIGS. 4-7 best illustrate that the housing 40 of the display terminal 30 may include a pair of aligned pivot pins 50 protruding outwardly from the housing in opposite directions thereof. These aligned pivot pins 50 define the rotational axis 48, and are rotatably received in a pair of aligned receiving holes 51 extending through the opposed sidewalls 52 of the support member 45. It will our course be appreciated that these pin and slot configurations between the terminal housing 40 and the frame sidewalls 52 without any loss of functionality.

Preferably, the tilt of the display terminal 30 can range from the horizontal position to about 60° from a horizontal plane. Any angular tilt position, however, can be permitted. To limit the tilt positions, one or more stop mechanisms (not shown) can be disposed within the receiving pocket 35 of the support member 45. In the example above, hence, the stop mechanisms can limit the rotation of the display terminal about the horizontal axis 48 to the horizontal position and at the 60° position.

To maintain the tilt position of the display terminal 30 after any adjustment by the player, and/or to facilitate operation of the touchscreen without rotating, any conventional securing technique can be applied. These include frictional retainment, and/or any locking mechanisms, etc.

Figure 6:
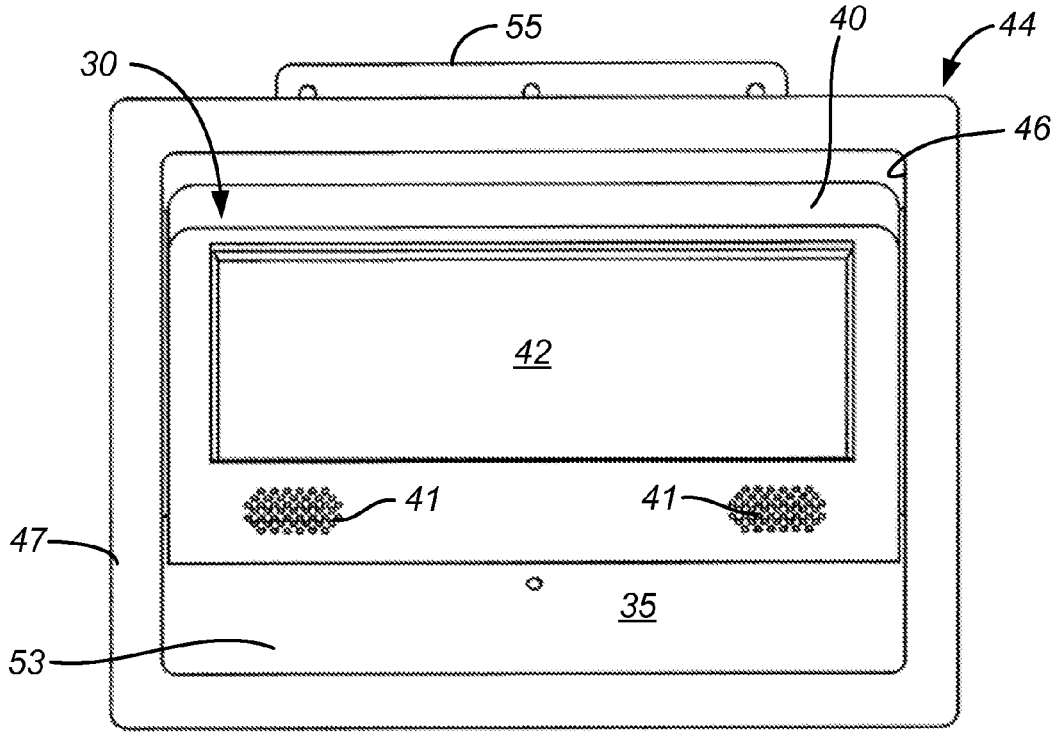
FIG. 6 is a top plan view of the interactive display terminal of FIG. 4 oriented in the tilted position.
Figure 7:
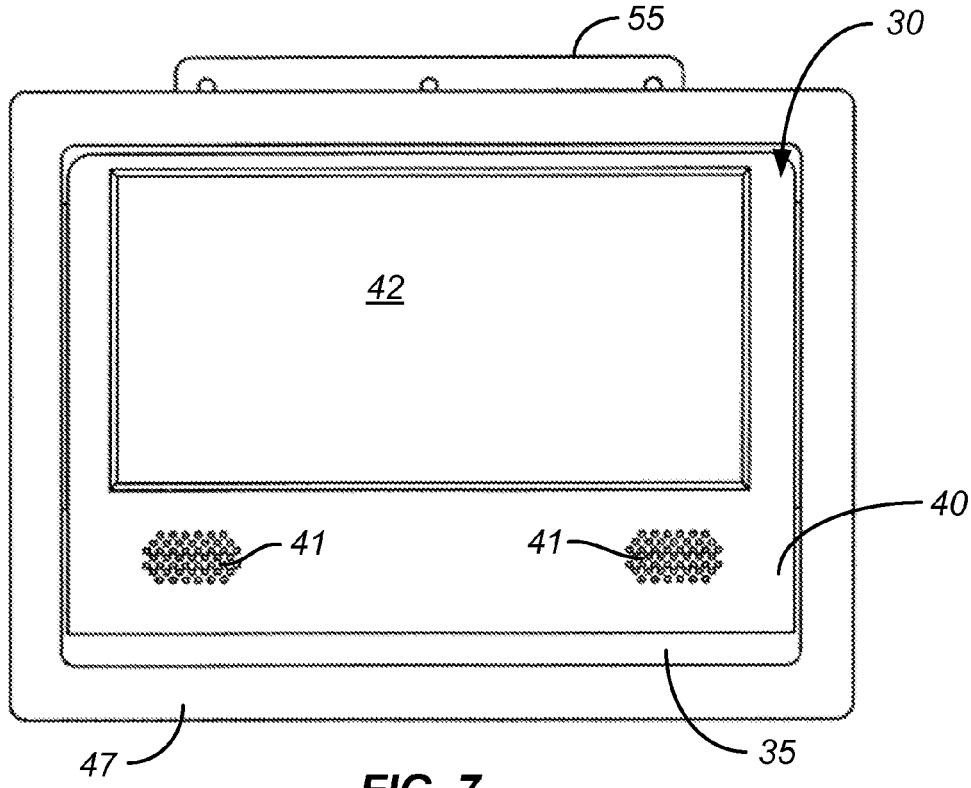
FIG. 7 is a top plan view of the interactive display terminal of FIG. 5 oriented in the horizontal position.

A downwardly depending front wall 53 of the support member 45 gently tapers inwardly. When the display terminals 30-34 are tilted toward the players, as shown in FIGS. 4 and 6, this sloped front wall 53 may function to limit the spacing with the lower portion of the terminal housing 40. This minimized spacing prevents objects from falling into the receiving pockets. Lastly, the exterior walls of the support member 45 include various mounting brackets 55 to facilitate support and mounting to the game table 21

Figure 8:
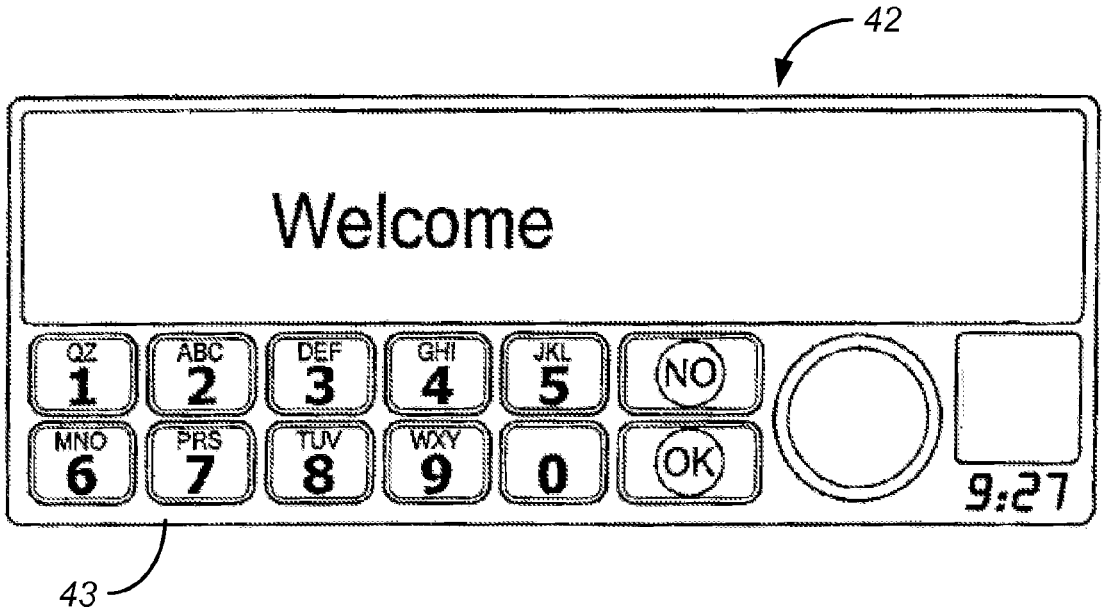
FIG. 8 is an enlarged view of the display screen of FIG. 7 depicting an exemplary "Welcome" screen.

These dedicated interactive player display terminals 30-34 can be applied to deliver information directly to the player at their respective player station 23-27 relating to advertising, news, etc, and/or function as a player tracking terminal. By way of example, the present implementation may also include an associated card reader (not shown in the drawings) or may facilitate player access to their accounts via entry of personal identification numbers into the touch screen on the displays (FIG. 8). This permits the player at the associated station, rather than the dealer or pit boss, to log in and out at one of player stations 23-27. In a sense, these terminals function as the player's own personal player tracking kiosk right at the gaming table. The display terminals, for instance, shown in the above-mentioned co-pending application may be operated in association with player tracking networks like those shown and disclosed in U.S. Pat. Nos. 5,665,961 and 6,319,125, both of which are also incorporated herein by reference.

The dedicated player display terminals 30-34 can also be applied to permit the player to participate in other games, not entirely associated with the table game being played. For example, the interactive display terminal at the gaming table could allow the player to select and participate in keno games, play a match game, spinning reel game, or other type of game while playing the table game. Funds for such game play, in addition to the table game being played, could be provided from the player's personal financial account, such as that described in co-pending U.S. patent application Ser. No. 10/652,155, filed Aug. 28, 2003, and entitled "Method and Apparatus for Facilitating Monetary and Reward Transactions and Accounting in a Gaming Environment", which is hereby incorporated by reference herein. As described above, the player could access their related player account by entering personal identification information via a swipe card and/or the touch screen at the player station.

In accordance with the present invention, it is this networked connection with the player tracking backend system and/or backend bonus game or award system that opens the gaming tables to a plethora of automated bonus games and bonus awards delivery. By registering the player in the system at a particular player station, the player will then be systematically identified at a particular table game player station. Accordingly, while the dedicated display terminal is significantly advantageous, the bonus delivery system of the present invention can function without it.

By way of example, a player at a gaming table may check into the player tracking system using their player tracking card. This may be performed through self check-in using the dedicated card reader at a player station or may be performed by the dealer or pit boss. Using a system, such as IGT's Table Touch™ system, a pit boss or dealer may swipe a player's card so that they are registered in the player tracking system, and rate or comp the player using an input device. At the same time, the system, the dealer or pit boss can register the player's position at the associated player station 23-27. In the most basic form of bonus award delivery, in accordance with the present invention, depending upon the players account qualifications, etc., a bonus award may be awarded and presented to that player at the game table 21.

In one instance, the backend system can identify the dedicated display terminal (i.e., between terminals 30-34) of the player station (23-37) that the winning player is located, and then directly inform the player of their award through the display terminal. This may be through a visual display on the display screen 42 and/or an audio display from the speakers 41. The display terminal, as shown in FIG. 8 for example, can be applied to inform the player that he or she has received a comp, such as a monetary award or a free dinner. In another example, the dealer's display terminal (not shown) may be utilized to inform the dealer of a particular player's bonus award, whereby the dealer can then notify the player. A printer (not shown) near the game table or in the pit area may be used to print a ticket or coupon that reflects the comp. The printer is connected to a network that includes the input device.

In still another embodiment of a bonus game and/or award delivery of the present invention, the dealer or pit boss can use their input device (e.g., the dealer's interactive Table Touch™ display terminal) to deliver a bonus to a selected player's account. Such award can then be announced to the player via their display screen 42 and/or speakers 41 of the associated display terminal 30-34.

In accordance with one embodiment of the present invention, much more sophisticated bonus award delivery and bonus game play can be attained at gaming tables applying the backend player tracking systems, the identified player positions and the development of recent technology. For example, it is now possible to determine and monitor what exact cards (suit and card value) have been dealt to each player station, as well as electronically sense and monitor the denomination and collective amount bet by a player at each respective player stations 23-27. By way of example, RFID technology has been employed to track the amount and denomination of chips wagered at any respective player station. By strategically positioning RFID antennas under the gaming table surface at each player station, and by embedding read-only electronic tags or transponders in each gaming chip, the number of chips, and their denomination can be electrically tracked via the respective antennas. Typical of such technology, for example, is disclosed in U.S. Pat. Nos. 5,651,548 and 5,735,742, both of which are incorporated by reference herein.

Other recent technology has also made possible the determination and monitoring of what cards (suit and card values) are being dealt to a particular playing station. Briefly, using modified card shoe apparatus that incorporate scanning and sensor device, each card is scanned as they leave the card shoe. A processing system recognizes and determines the card suit and card value, and notes which card has been dealt to which player station. Typical of such technology, for example, is disclosed in U.S. Pat. Nos. 6,039,650; 6,299,536 and 6,582,301, all of which are incorporated by reference herein.

Applying such technologies, together with the player tracking systems, much more sophisticated and automated bonus award delivery and/or bonus game play at a gaming table can be attained. In addition to the above-mention instant triggering of bonus award as a result of dealer or pit boss action at the input device, for instance, the player tracking system may automatically trigger a bonus to a particular player as a result of game play criteria associated with the table game, and that is encoded in the player tracking system. Such criteria may relate to the size of a wager or cumulative wagers, the size of a loss or cumulative losses, the size of a win or cumulative wins, or any other predetermined formula or criteria that can be predefined in the player tracking system. Such systems, however, could not be automated without the integration with the recent technologies above-mentioned.

Applying such technology, in accordance with one embodiment of the present invention, the predetermined formula to determine bonus game play may be associated with a predetermined card or pair of cards dealt. When such card or cards are detected as being dealt to a particular player station, should that player be participating in the bonus game, the player (or the dealer) will automatically be informed of such bonus award, via the display terminal. In alternative games, such lucky bonus card or cards may be selected randomly by the backend system, and hence may issued to the players as a complete surprise. This element of surprise adds mystery and fun to the table game. In another example having an element of surprise, a "mystery" bonus game be played where after a predetermined period of time, one player or more players may be randomly selected to be the recipient of the bonus award. Any such bonus games, it will be appreciated, can be run singularly or simultaneously in one or more combinations.

Figure 9:
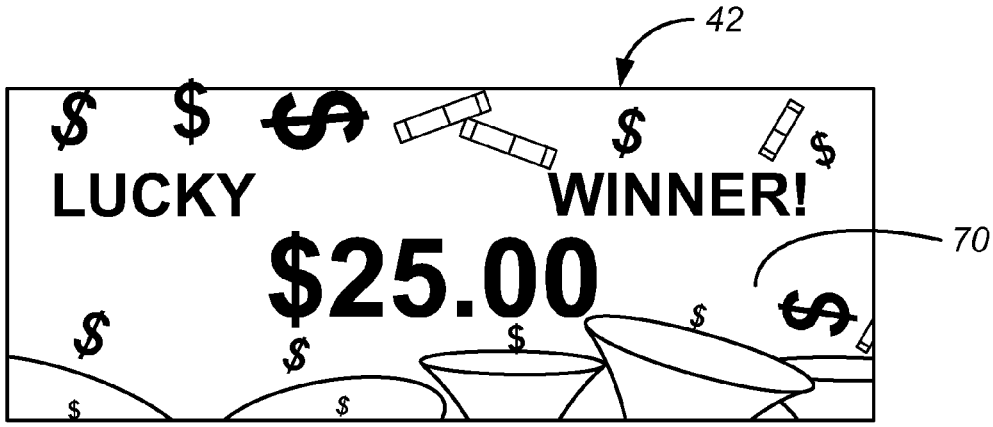
FIG. 9 is an enlarged view of the display screen of FIG. 7 depicting an exemplary "Lucky Winner" screen.

In any event, the system determines which player station 23-27, if any, received the "lucky" card or cards, and identifies whom the recipient is. Then the system can automatically inform the player of their bonus award via the display screen 42 and/or speakers 41 of the respective display terminal 30-34 of that player's station 23-27. In one particular example, the player may informed by the graphic "Lucky Winner" 70, depicted in FIG. 9, in the display screen 42.

Applying the network backend player tracking systems and/or backend bonus systems throughout the casino or casinos, or merely any combination of participating game tables, the bonus games above mentioned could be more pool oriented. Hence, the bonus awards are funded by the participants of the bonus game. In one example, a predetermined percentage of a participant's bet can be automatically wagered and entered into a pool. Using the RFID technology mentioned, that predetermined percentage of the participants wager is automatically calculated, and entered into the pool of participants for the bonus game. Again, depending upon the predetermined winning formula (e.g., combination of cards), a player meeting such criteria may win the pool. As mentioned above, the system can automatically inform the player of their bonus award via the display screen 42 of the respective display terminal 30-34 of that player's station 23-27.

In another example, the bonus award and bonus games can be more "bonus" oriented whereby the bonus game and bonus awards are funded through promotional money. These bonus awards are presented to entice the player to frequent the gaming establishment more. In these "bonus" oriented awards, the system can provide awards that need not be tied to game play of the table game on a particular game table. Awards that are independent of game play on the table facilitate a desire on the part of a casino to present comps and prizes randomly or to frequent players.

Examples of player awards using the present system include free food or services, such as complementary buffets and drinks, complementary hotel room, or other complementary food or services provided by the casino. Such awards may also comprise credits for further gaming at the table or at other casino games. They may include free credits or matching credits, i.e., one free credit for each one played by the player up to a predefined limit.

All of the foregoing bonus awards may be limited to specified times during which they may be redeemed. An award may also include a cash prize. Awards like the foregoing may be awarded to multiple players at once. For example, all of the players at a specified table during at a particular time may be awarded free buffets. In another example of multiple awards, players may be awarded a secondary prize after one player wins a top award. A player may be notified of his or her award via display graphics or sound from the speaker associated with the display, or both. In addition, display graphics and sound may be used for marketing promotions and to promote various events.

Although the foregoing invention has been described in some detail for purposes of clarity of understanding, it will be apparent that certain changes and modifications may be practiced within the scope of the appended claims. As such, it is apparent that virtually any predetermined formula can be employed to deliver the bonus award or bonus game using the backend systems and gaming table combination as disclosed in accordance with the present invention.

What is claimed is:

1. A method of delivering a bonus award to a player playing a table game at a gaming table, said gaming table having a dealer station for a game dealer, and a plurality of player stations for one or more players, said method comprising:

registering the position of the player at one of the plurality of playing stations, wherein an individual player display terminal is associated with each playing station;

receiving a bet from said player;

electronically tracking an amount bet by said player;

placing a portion of said player's bet into a bonus pool for the bonus award;

commencing play of the table game;

issuing the bonus award to said player based upon a criterion selected from the group consisting of the amount bet, an amount of cumulative bets, an amount of a loss, an amount of cumulative losses, an amount of a win, and an amount of cumulative wins;

informing said player of their bonus award status through the individual player display terminal associated with the playing station that the player is registered at; and presenting a game not associated with the table game to said player through the individual player display terminal associated with the playing station that the player is registered at.

2. The method according to claim 1, wherein said portion includes a percentage of the player's bet.

3. The method according to claim 1, wherein said placing a portion of the player's bet includes:

calculating said portion based upon the amount of the player's bet.

4. The method according to claim 1, wherein said bonus award further comprises an award selected from the group consisting of a promotional ticket, immediate cash back, and a payout that requires pit boss approval.

5. The method according to claim 1, further including:

enabling the player to selectively rotationally orient the player display terminal about a generally horizontal axis between a generally horizontal position to a plurality of positions slanted toward the player seated at a player station.

6. The method according to claim 1, further including:

informing the dealer of a player's bonus award status through a dealer display terminal dedicated to the dealer station.

7. The method according to claim 1, further including:

registering a plurality of players of the table game in the player tracking system;

registering the position of each player at one of the plurality of playing stations;

receiving bets from each said player;

electronically tracking amounts bet by each said player;

placing a portion of each said players' bet into a bonus pool for the bonus award; and issuing the bonus award to at least one of said players based upon said criterion.

8. The method according to claim 1, wherein said table game is a card game.

9. The method according to claim 1, wherein the game not associated with the table game is selected from the group consisting of keno, a match game, and a spinning reel game.

10. A gaming table assembly for a table game for delivering a bonus award to a player at the gaming table comprising:

a gaming table;

a dealer station for a gaming dealer;

a plurality of discrete player stations for one or more players;

an electronic system configured to track an amount bet by said player; and a plurality of interactive display terminals associated with the gaming table, each display terminal dedicated to one of the plurality of discrete player stations, each said display terminal including a touch screen display configured to accept input and to display bonus awards, a game not associated with the table game, a bonus game, an advertisement, player tracking information, and news, wherein the bonus awards are funded by said one or more players, wherein a criterion for issuing the bonus award to said player is selected from the group consisting of the amount bet, an amount of cumulative bets, an amount of a loss, an amount of cumulative losses, an amount of a win, and an amount of cumulative wins.

11. The gaming table assembly accordingly to claim 10, wherein each display terminal is recess into a pocket defined by a surface of the gaming table.

12. The gaming table assembly according to claim 10, wherein each said interactive display terminal includes a tilt mechanism associated with the respective display screen to enable selective rotational movement about a generally horizontal axis between a generally horizontal position to a plurality of positions slanted toward a respective player seated at a respective player station.

13. The gaming table assembly accordingly to claim 12, wherein said rotational movement of the display screen generally about the horizontal axis is between about 0°, relative to horizontal, to about 60°, relative to the horizontal.

14. The method according to claim 10, wherein the game not associated with the table game is selected from the group consisting of keno, a match game, and a spinning reel game.

15. A bonus game delivery system for a gaming table, said gaming table including a gaming table having a dealer station for a gaming dealer, and a plurality of discrete player stations for one or more players, said delivery system comprising:

an electronic system configured to track an amount bet by each of said one or more players;

a backend bonus award system, wherein a bonus award is funded by said one or more players, wherein a criterion for issuing the bonus award to at least one of said players is selected from the group consisting of the amount bet, an amount of cumulative bets, an amount of a loss, an amount of cumulative losses, an amount of a win, and an amount of cumulative wins; and a plurality of discrete terminals, wherein one discrete terminal is associated with each player station at said gaming table, each terminal being networked to and discretely identified by said bonus award system such that a player identified by said bonus award system as being eligible for the bonus award is informed of said bonus award through a respective touch screen display of the associated discrete terminal, each discrete terminal being further configured to display and accept input for a game not associated with a gaming table game.

16. The bonus game delivery system accordingly to claim 15, wherein each discrete terminal includes at least one speaker.

17. The bonus game delivery system accordingly to claim 15, wherein each discrete terminal includes a support mechanism adapted to mount to said gaming table, said support mechanism defining a receiving pocket formed and dimensioned for receipt of a respective terminal therein.

18. The bonus game delivery system according to claim 15, wherein said backend bonus award system is configured to offer a bonus award game to participant players on each of said terminals.

19. The bonus game delivery system according to claim 15, wherein each said discrete terminal includes a tilt mechanism associated with the respective display screen to enable selective rotational movement about a generally horizontal axis between a generally horizontal position to a plurality of positions slanted toward a respective player seated at a respective discrete player station.

20. The method according to claim 15, wherein the game not associated with the gaming table game is selected from the group consisting of keno, a match game, and a spinning reel game.

* * * * *